US007230390B2

(12) United States Patent
Wu

(10) Patent No.: US 7,230,390 B2
(45) Date of Patent: Jun. 12, 2007

(54) COLD CATHODE FLUORESCENT LAMP ASSEMBLY

(75) Inventor: Chao-Hua Wu, Chung Ho (TW)

(73) Assignee: Top Victory Electronics (Taiwan) Co., Ltd., Taipei Hsien (TW)

( * ) Notice: Subject to any disclaimer, the term of this patent is extended or adjusted under 35 U.S.C. 154(b) by 26 days.

(21) Appl. No.: 11/197,305

(22) Filed: Aug. 5, 2005

(65) Prior Publication Data

US 2007/0029944 A1 Feb. 8, 2007

(51) Int. Cl.
*H05B 37/02* (2006.01)

(52) U.S. Cl. ..... 315/213; 315/220; 315/312

(58) Field of Classification Search ..... 315/210–213, 315/219, 220, 224–226, 291, 307, 312, 320, 315/324, DIG. 2, DIG. 5
See application file for complete search history.

(56) References Cited

U.S. PATENT DOCUMENTS 6,104,146 A * 8/2000 Chou et al. ..... 315/277
2005/0140312 A1* 6/2005 Nishinosono et al. ..... 315/224
2005/0141247 A1* 6/2005 Huang ..... 363/24
2006/0022610 A1* 2/2006 Ball ..... 315/213

* cited by examiner

*Primary Examiner*—Thuy Vinh Tran
(74) *Attorney, Agent, or Firm*—Harness, Dickey & Pierce P.L.C.

(57) ABSTRACT

A cold cathode fluorescent lamp (CCFL) assembly includes a pair of CCFLs, and an inverter-type drive circuit. The drive circuit includes a first transformer having a primary winding adapted to be coupled to a power supply module, and a secondary winding with a pair of terminals. The CCFLs are coupled respectively to the terminals of the secondary winding. The drive circuit further includes a push-pull drive circuit coupled to the primary winding of the first transformer, and adapted to be coupled to the power supply module. The push-pull drive circuit excites the primary winding of the first transformer upon receiving power from the power supply module such that power is transferred from the primary winding to the secondary winding, thus activating the CCFLs coupled thereto.

13 Claims, 4 Drawing Sheets

COLD CATHODE FLUORESCENT LAMP ASSEMBLY

BACKGROUND OF THE INVENTION

1. Field of the Invention

The present invention relates to a cold cathode fluorescent lamp (CCFL) assembly, and to an inverter-type drive circuit thereof.

2. Description of the Related Art

A liquid crystal display (LCD) uses a CCFL as a backlight source. The CCFL is typically driven by an inverter-type drive circuit.

Referring to FIG. 1, a CCFL assembly disclosed in Taiwanese Patent Publication No. 521947 is shown to include an inverter-type drive circuit 1. The inverter-type drive circuit 1 is controlled by a power supply module 20 to drive CCFLs 21, 22, which are coupled to the inverter-type drive circuit 1 and further coupled in parallel to each other. The inverter-type drive circuit 1 includes a transformer 12, and a push-pull drive circuit 11 having a pair of transistors (Q1, Q2) and a capacitor (C1). A primary winding of the transformer 12 includes an excitation coil (Lm) and a drive control coil (Ld). The excitation coil (Lm) is center-tapped and coupled to the power supply module 20. The transistors (Q1, Q2) have collectors coupled to the excitation coil (Lm), bases coupled to the drive control coil (Ld) , and grounded emitters. One terminal of a secondary winding of the transformer 12 is connected to the CCFLs 21, 22 respectively through high voltage capacitors (C2, C3).

During operation of the inverter-type drive circuit 1, the drive control coil (Ld) alternately drives the transistors (Q1, Q2) to conduct to thereby excite the excitation coil (Lm). This results in the transfer of power from the excitation coil (Lm) to the secondary winding, thereby activating the CCFLs 21, 22.

However, since impedances of the CCFLs 21, 22 may not be identical, currents passing through the parallel-connected CCFLs 21, 22 may differ. This may result in different brightness levels between the CCFLs 21, 22. Therefore, a balance transformer 13 is coupled between one terminal of each of the CCFLs 21, 22 and one terminal of the secondary winding of the transformer 12. While the balance transformer 13 ensures that the currents flowing to the CCFLs 21, 22 are uniform, circuit complexity and size are increased.

In addition, since the inverter-type drive circuit 1 is able to drive a maximum of only two of the CCFLs 21, 22, more of the inverter-type drive circuits 1 are required if it is desired to operate additional CCFLs. This further increases circuit complexity and takes up significant space.

FIG. 2 shows a CCFL assembly including an inverter-type drive circuit 6 disclosed in U.S. Pat. No. 5,495,405. A primary-side circuit 61 of the drive circuit 6 is capable of driving only a single transformer. In a secondary-side circuit 62 of the drive circuit 6, there is provided an additional inductor 63, and a high voltage capacitor 64 and a CCFL 65 are connected in parallel. Only the single CCFL 65 may be driven with this configuration such that when it is desired to drive additional lamps, it is necessary to use a corresponding number of the drive circuits 6. Hence, the same problems of increased circuit complexity and significant use of space are encountered with this prior art structure.

SUMMARY OF THE INVENTION

Therefore, the object of this invention is to provide a cold cathode fluorescent lamp (CCFL) assembly and an inverter-type drive circuit thereof that are relatively simple in structure, that can ensure uniform lamp currents, and that allow for the operation of more than two CCFLs.

The CCFL assembly of this invention comprises: a first pair of CCFLs each having first and second terminals; and an inverter-type drive circuit. The inverter-type circuit includes a first transformer including a primary winding adapted to be coupled to a power supply module, and a secondary winding having a pair of terminals, the first terminals of the first pair of CCFLs being coupled respectively to the terminals of the secondary winding; and a push-pull drive circuit coupled to the primary winding of the first transformer, and adapted to be coupled to the power supply module. The push-pull drive circuit excites the primary winding of the first transformer upon receiving power from the power supply module such that power is transferred from the primary winding to the secondary winding, thus activating the first pair of CCFLs coupled thereto.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 3:
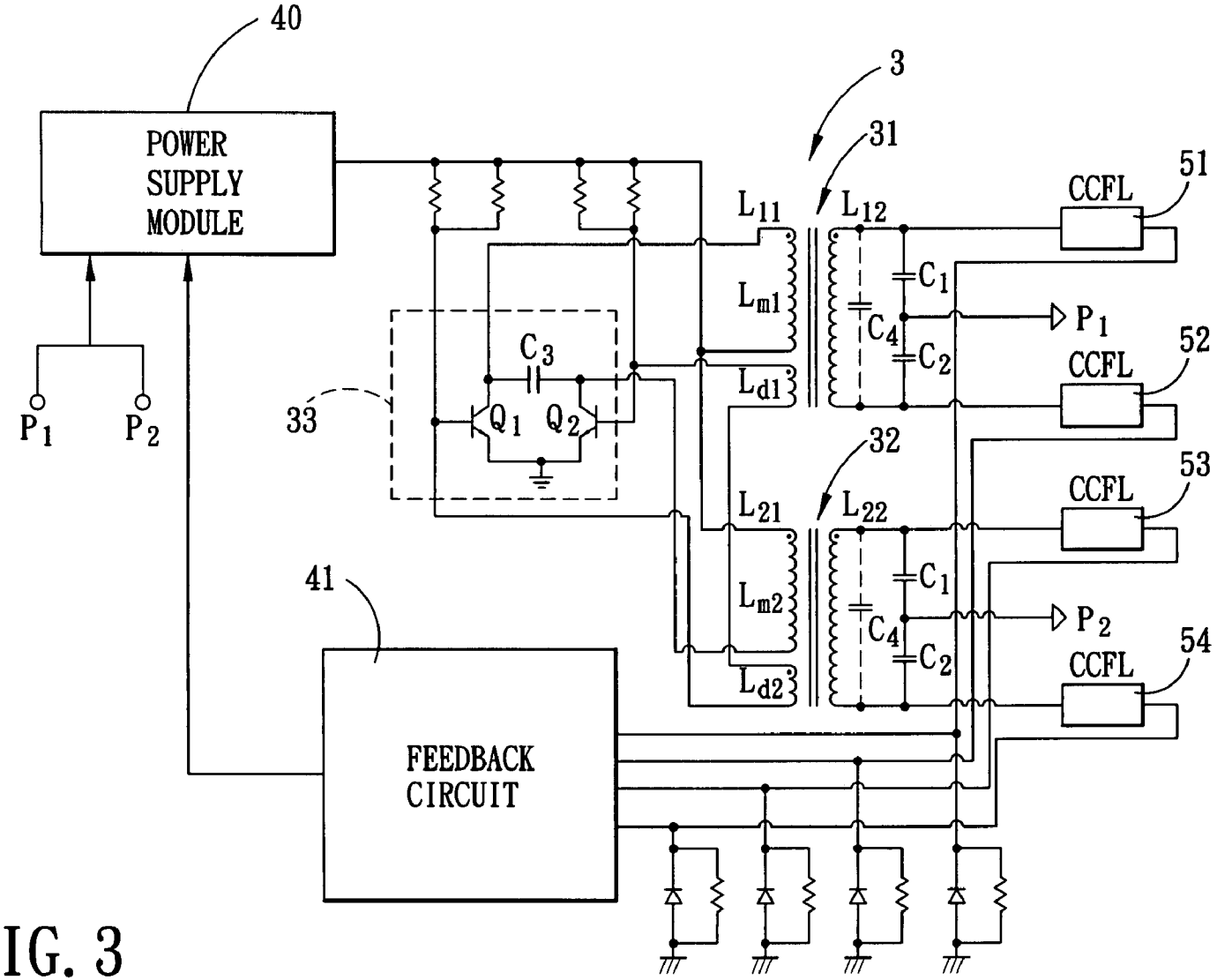
FIG. 3 is a schematic circuit diagram of a CCFL assembly according to a preferred embodiment of the present invention.
Figure 4:
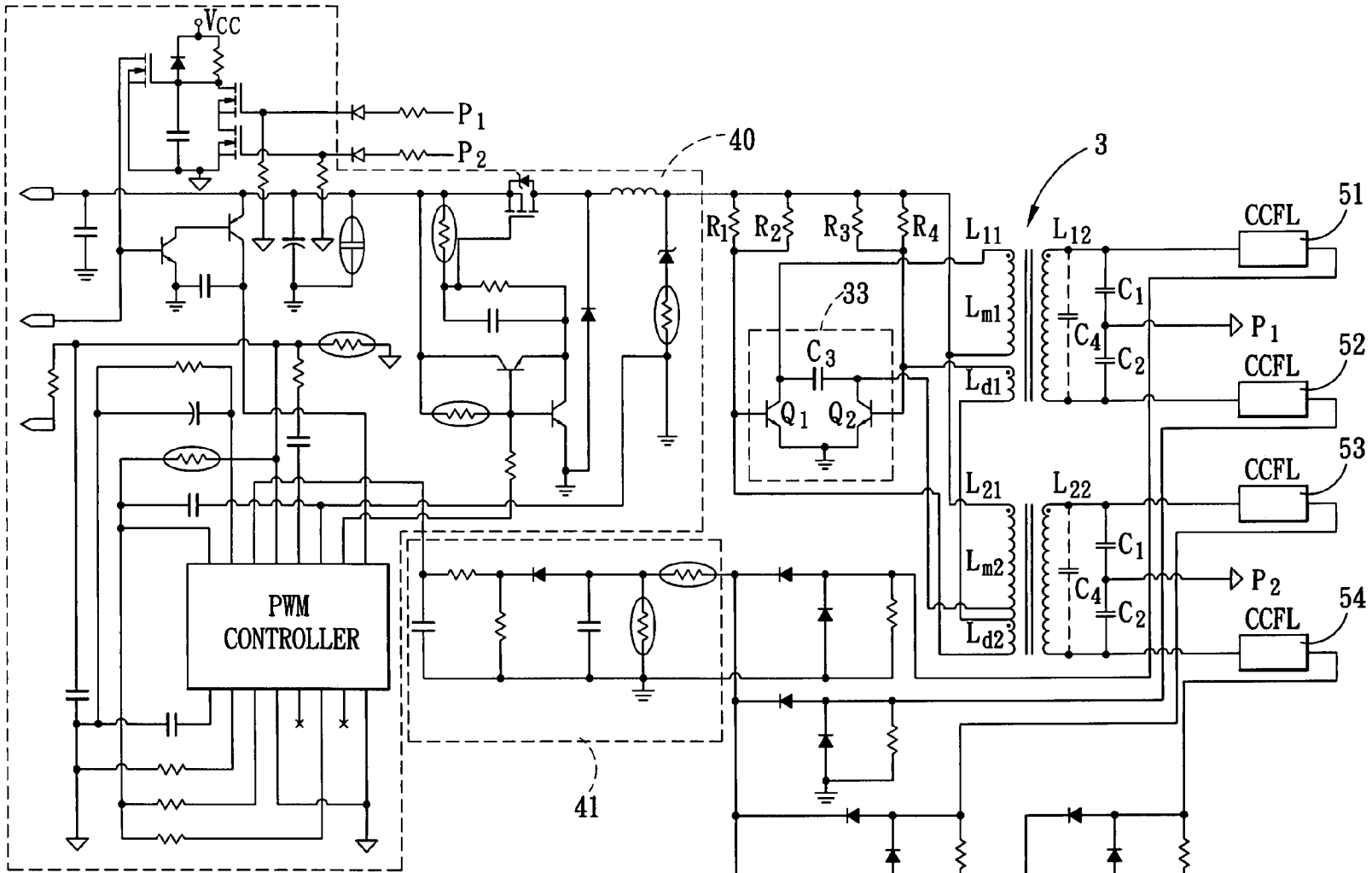
FIG. 4 is a view similar to FIG. 3, but illustrating a power supply module and a feedback loop of the CCFL assembly in greater detail.

Referring to FIGS. 3 and 4, a cold cathode fluorescent lamp (CCFL) assembly according to a preferred embodiment of the present invention includes first and second pairs of CCFLs 51, 52 and 53, 54, an inverter-type drive circuit 3, a power supply module 40, and a feedback circuit 41.

Each of the CCFLs 51–54 includes first and second terminals. The CCFLs 51–54 receive power from the power supply module 40 via the inverter-type drive circuit 3. Detailed circuitry of the power supply module 40 is shown in FIG. 4. However, since the primary features of this invention do not reside in the particular configuration of the power supply module 40, a detailed description of the same will be omitted herein for the sake of brevity. The operation of the feedback circuit 41 will be described below subsequent to the description of the inverter-type drive circuit 3.

The inverter-type drive circuit 3 includes a first transformer 31, a second transformer 32, and a push-pull drive circuit 33.

The first transformer 31 includes a primary winding (L11) having an excitation coil (Lm1) with a first terminal and a second terminal, and further having a drive control coil (Ld1) with a third terminal and fourth terminal. The second terminal of the excitation coil (Lm1) of the primary winding (L11) is coupled to the power supply module 40. The first transformer 31 further includes a secondary winding (L12) having a first terminal and a second terminal. The first pair of the CCFLs 51, 52 are respectively coupled to the first and second terminals of the secondary winding (L12).

The second transformer 32 includes a primary winding (L21) having an excitation coil (Lm2) with a first terminal and a second terminal, and further having a drive control coil (Ld2) with a third terminal and a fourth terminal. The first terminal of the excitation coil (Lm2) of the second transformer 32 is coupled to the second terminal of the excitation coil (Lm1) of the first transformer 31, as well as to the power supply module 40. The second transformer 32 further includes a secondary winding (L22) having a first terminal and a second terminal. The second pair of the CCFLs 53, 54 are respectively coupled to the first and second terminals of the secondary winding (L22) of the second transformer 32.

The push-pull drive circuit 33 includes a capacitor (C3) , and a pair of first and second transistors (Q1, Q2) each having a collector, a base, and an emitter. The collectors of the first and second transistors (Q1, Q2) are coupled to the excitation coils (Lm1, Lm2) of the first and second transformers 31, 32, respectively. The bases of the first and second transistors (Q1, Q2) are respectively coupled to the drive control coils (Ld2, Ld1) of the second and first transformers 32, 31, and are further coupled to the power supply module 40. The emitters of the first and second transistors (Q1, Q2) are grounded. The capacitor (C3) is coupled between the collectors of the first and second transistors (Q1, Q2).

A resonance frequency generated by the capacitor (C3) of the push-pull drive circuit 33 and the drive control coils (Ld1, Ld2) of the first and second transformers 31, 32 corresponds to an operating frequency of the CCFLs 51–54.

The drive control coils (Ld1, Ld2) control the push-pull drive circuit 33 to alternatingly excite the excitation coils (Lm1, Lm2) of the first and second transformers 31, 32 such that power supplied by the power supply module 40 is transferred from the excitation coil Lm1 of the primary winding (L11) of the first transformer 31 to the secondary winding (L12) of the first transformer 31, and from the excitation coil (Lm2) of the primary winding (L21) of the second transformer 32 to the secondary winding (L22) of the second transformer 32. As a result, the first and second pairs of the CCFLs 51, 52 and 53, 54 coupled respectively to the secondary windings (L12, L22) of the first and second transformers 31, 32 are activated.

During the above operation, the drive control coils (Ld1, Ld2) alternately drive the transistors (Q1, Q2) to ON and OFF states. When the transistor (Q1) is turned ON, current passes through the excitation coil (Lm1) to excite the same. When the transistor (Q1) is subsequently turned OFF and the transistor (Q2) turned ON, current passes through the excitation coil (Lm2) to excite the same. This process is repeated continuously during the operation of the CCFL assembly.

The CCFL assembly further includes a pair of high-voltage capacitor units respectively coupled in parallel to the secondary windings (L12, L21) of the first and second transformers 31, 32. Capacitances of the high-voltage capacitor units and stray capacitances associated with the first and second transformers 31, 32 are used to supplement a resonant capacitance required by the first and second transformers 31, 32. Further, resonances of the secondary windings (L12, L22) of the first and second transformers 31, 32, the high-voltage capacitor units coupled in parallel to the secondary windings (L12, L22) of the first and second transformers 31, 32, and the CCFLs 51–54 generate a resonance frequency corresponding to an operating frequency of the CCFLs 51–54.

The high-voltage capacitor unit coupled to each of the first and second transformers 31, 32 includes a pair of capacitors (C1, C2) coupled in series and interconnected at a junction node. Alternatively, each of the high-voltage capacitor units may include a single capacitor (C4). When the pairs of the capacitors (C1, C2) are used, the power supply module 40 is coupled to a pair of detection points (P1, P2) positioned respectively at the junction nodes of the capacitors (C1, C2) of the high-voltage capacitor units coupled to the first and second transformers 31, 32. The power supply module 40 controls the supply of power to the inverter-type drive circuit 3 according to detected voltage changes at the detection points (P1, P2). As an example, this may be used as a safety function in which the power supply module 40 discontinues the supply of power to the inverter-type drive circuit 3 when the power supply module 40 determines from the detected voltages at the detection points (P1, P2) that any one of the CCFLs 51–54 is not coupled to the corresponding terminal of the first and second transformers 31, 32.

The feedback circuit 41 is coupled to the power supply module 40, and to the second terminals of each of the CCFLs 51–54. The feedback circuit 41 performs feedback of currents that passed through each of the CCFLs 51–54 to the power supply module 40. The power supply module 40 is responsive to the feedback of currents from the feedback circuit 41 so as to provide a stable supply of power to the inverter-type drive circuit 3.

Figure 1:
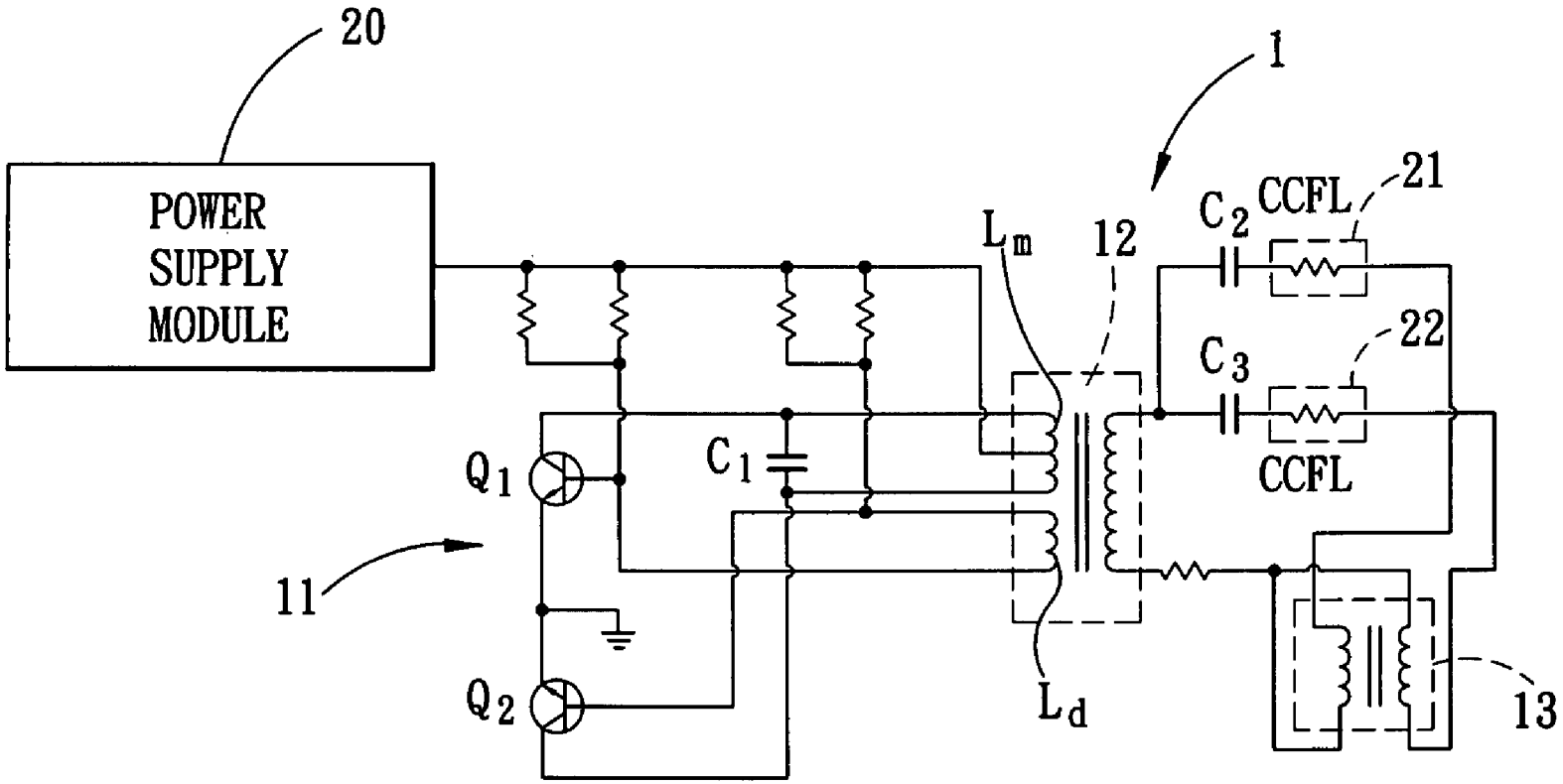
FIG. 1 PRIOR ART
FIG. 1 is a schematic circuit diagram of a conventional cold cathode fluorescent lamp (CCFL) assembly.
Figure 2:
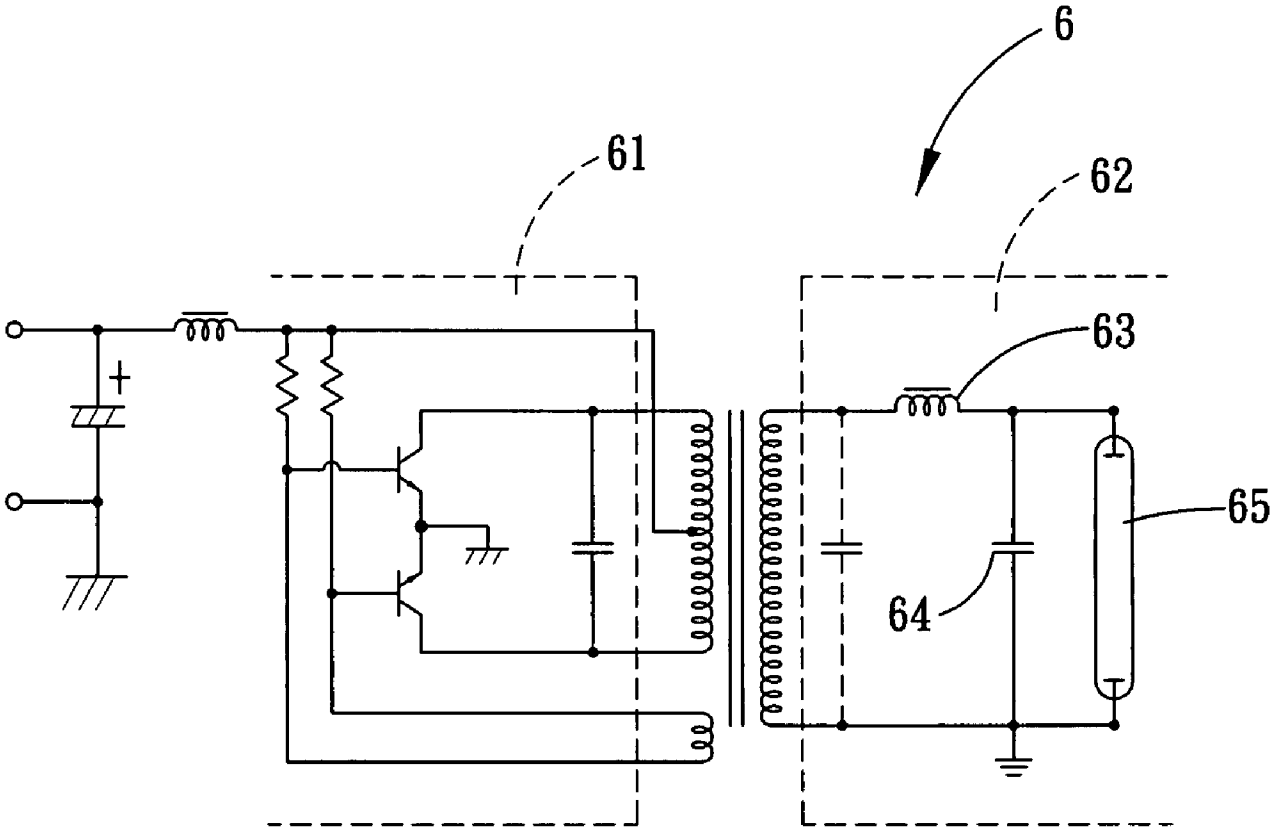
FIG. 2 PRIOR ART
FIG. 2 is a schematic circuit diagram of another conventional CCFL assembly.

The CCFL assembly of the preferred embodiment has many advantages over the conventional circuits 1, 6 (see FIGS. 1 and 2). In particular, the CCFL assembly simplifies circuit structure, reduces the amount of space used by the circuitry of the CCFL assembly, and allows for four of the CCFLs 51–54 to be driven at once. Furthermore, due to the connection of the CCFLs 51–54 in series with the secondary windings (L12, L22) of the first and second transformers 31, 32, even if impedances of the CCFLs 51–54 are different, a situation of non-uniform currents does not occur so that the CCFLs 51–54 are uniformly illuminated, thereby making unnecessary the use of a balance transformer and additionally simplifying circuit structure.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A cold cathode fluorescent lamp (CCFL) assembly, comprising:

a first pair and a second pair of CCFLs, each CCFL having first and second terminals; and an inverter-type drive circuit including a first transformer including a primary winding adapted to be coupled to a power supply module, and a secondary winding having a pair of terminals, said first terminals of said first pair of CCFLs being coupled respectively to said terminals of said secondary winding, and a second transformer having a primary winding adapted to be coupled to the power supply module, and coupled to said push-pull drive circuit, said second transformer further having a secondary winding having a pair of terminals, said first terminals of said second pair of CCFLs being coupled respectively to said terminals of said secondary winding of said second transformer; and a push-pull drive circuit coupled to said primary winding of said first transformer, and adapted to be coupled to the power supply module, said push-pull drive circuit exciting said primary winding of said first transformer upon receiving power from the power supply module such that power is transferred from said primary winding to said secondary winding, thus activating said first pair of CCFLs coupled thereto and exciting said primary winding of said second transformer upon receiving power from the power supply module such that power is transferred from said primary winding of said second transformer to said secondary winding of said second transformer, thus activating said second pair of CCFLs coupled thereto.

2. The CCFL assembly of claim 1 further comprising a pair of high-voltage capacitor units respectively coupled in parallel to said secondary windings of said first and second transformers, capacitances of said high-voltage capacitor units and stray capacitances associated with said first and second transformers being used to supplement a resonant capacitance required by said first and second transformers.

3. The CCFL assembly of claim 2, wherein resonances of said secondary windings of said first and second transformers, said high-voltage capacitor units coupled in parallel to said secondary windings of said first and second transformers, and said CCFLs generate a resonance frequency corresponding to an operating frequency of said CCFLs.

4. The CCFL assembly of claim 1, wherein said primary windings of said first and second transformers respectively include excitation coils each having a first terminal and a second terminal, and drive control coils each having a third terminal and a fourth terminal, said second terminal of said excitation coil of said first transformer being coupled to said first terminal of said excitation coil of said second transformer, said first terminal of said excitation coil of said first transformer and said second terminal of said excitation coil of said second transformer being respectively coupled to said push-pull drive circuit, said fourth terminal of said drive control coil of said first transformer being coupled to said third terminal of said drive control coil of said second transformer, said third terminal of said drive control coil of said first transformer and said fourth terminal of said drive control coil of said second transformer being respectively coupled to said push-pull drive circuit, said drive control coils controlling said push-pull drive circuit to alternatingly excite said excitation coils of said first and second transformers.

5. The CCFL assembly of claim 4, wherein said push-pull drive circuit includes a capacitor, and a pair of first and second transistors each having a collector, a base, and an emitter;

said collectors of said first and second transistors being coupled to said excitation coils of said first and second transformers, respectively;

said bases of said first and second transistors being respectively coupled to said drive control coils of said second and first transformers, and being adapted to be further coupled to the power supply module;

said emitters of said first and second transistors being grounded;

said capacitor being coupled between said collectors of said first and second transistors.

6. The CCFL assembly of claim 5, wherein a resonance frequency generated by said capacitor of said push-pull drive circuit and said drive control coils of said first and second transformers corresponds to an operating frequency of said CCFLs.

7. A cold cathode fluorescent lamp (CCFL) assembly, comprising:

first and second pairs of CCFLs each having first and second terminals;

a power supply module; and an inverter-type drive circuit including a first transformer including a primary winding coupled to said power supply module, and a secondary winding having a pair of terminals, said first terminals of said first pair of CCFLs being coupled respectively to said terminals of said secondary winding, a second transformer having a primary winding coupled to said power supply module, and further coupled to said push-pull drive circuit, said second transformer further having a secondary winding having a pair of terminals, said first terminals of said second pair of CCFLs being coupled respectively to said terminals of said secondary winding of said second transformer, and a push-pull drive circuit coupled to said primary windings of said first and second transformers, and further coupled to said power supply module, said push-pull drive circuit exciting said primary windings of said first and second transformers upon receiving power from said power supply module such that power is transferred from said primary winding of said first transformer to said secondary winding of said first transformer, and from said primary winding of said second transformer to said secondary winding of said second transformer, thus activating said first and second pairs of CCFLs coupled respectively to said secondary windings of said first and second transformers.

8. The CCFL assembly of claim 7, further comprising a feedback circuit coupled to said power supply module, said second terminals of each of said CCFLs being coupled to said feedback circuit, said feedback circuit performing feedback of currents that passed through each of said CCFLs to said power supply module, said power supply module being responsive to the feedback of currents from said feedback circuit so as to provide a stable supply of power to said inverter-type drive circuit.

9. The CCFL assembly of claim 7, further comprising a pair of high-voltage capacitor units respectively coupled in parallel to said secondary windings of said first and second transformers, capacitances of said high-voltage capacitor units and stray capacitances associated with said first and second transformers being used to supplement a resonant capacitance required by said first and second transformers.

10. The CCFL assembly of claim 9, wherein said high-voltage capacitor unit coupled to each of said first and second transformers includes a pair of capacitors coupled in series and interconnected at a junction node, said power supply module being coupled to a pair of detection points positioned respectively at said junction nodes of said capacitors of said high-voltage capacitor units, said power supply module controlling supply of power to said inverter-type drive circuit according to detected voltage changes at said detection points.

11. An inverter-type drive circuit, comprising:

a first transformer including a primary winding having an excitation coil with a first terminal and a second terminal, and further having a drive control coil with a third terminal and a fourth terminal, said second terminal of said excitation coil of said primary winding being adapted to be coupled to a power supply module, and a secondary winding having a first terminal and a second terminal, at least one of said first and second terminals of said secondary winding of said first transformer being adapted to be coupled to a cold cathode fluorescent lamp (CCFL);

a second transformer including a primary winding having an excitation coil with a first terminal and a second terminal, and further having a drive control coil with a third terminal and a fourth terminal, said first terminal of said excitation coil of said second transformer being coupled to said second terminal of said excitation coil of said first transformer, and a secondary winding having a first terminal and a second terminal, at least one of said first and second terminals of said secondary winding of said second transformer being adapted to be coupled to a CCFL; and a push-pull drive circuit coupled to said first terminals of said excitation coil and said drive control coil of said first transformer, coupled to said second terminals of said excitation coil and said drive control coil of said second transformer, and being adapted to be coupled to the power supply module, said push-pull drive circuit alternatingly exciting said excitation coils of said first and second transformers by control of said drive control coils such that power is transferred from said excitation coil of said primary winding of said first transformer to said secondary winding of said first transformer, and from said excitation coil of said primary winding of said second transformer to said secondary winding of said second transformer, thus activating the CCFLs coupled to said secondary windings of said first and second transformers.

12. The inverter-type drive circuit of claim 11, wherein said push-pull drive circuit includes a capacitor, and a pair of first and second transistors each having a collector, a base, and an emitter;

said collectors of said first and second transistors being coupled to said excitation coils of said first and second transformers, respectively;

said bases of said first and second transistors being respectively coupled to said drive control coils of said second and first transformers, and being adapted to be further coupled to the power supply module;

said emitters of said first and second transistors being grounded;

said capacitor being coupled between said collectors of said first and second transistors.

13. The inverter-type drive circuit of claim 12, wherein a resonance frequency generated by said capacitor of said push-pull drive circuit and said drive control coils of said first and second transformers corresponds to an operating frequency of the CCFLs.

* * * * *